US011686491B2

(12) United States Patent
Noor et al.

(10) Patent No.: US 11,686,491 B2
(45) Date of Patent: Jun. 27, 2023

(54) SYSTEMS FOR REFRIGERANT LEAK DETECTION AND MANAGEMENT

(71) Applicant: Johnson Controls Technology Company, Auburn Hills, MI (US)

(72) Inventors: Aneek M. Noor, Wichita, KS (US); Shawn A. Hern, Derby, KS (US); Tyler P. McCune, El Dorado, KS (US); Cody J. Kaiser, Wichita, KS (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 222 days.

(21) Appl. No.: 16/289,091

(22) Filed: Feb. 28, 2019

(65) Prior Publication Data

US 2020/0263891 A1 Aug. 20, 2020

Related U.S. Application Data

(60) Provisional application No. 62/808,098, filed on Feb. 20, 2019.

(51) Int. Cl.
*F24F 11/36* (2018.01)
*F24F 11/61* (2018.01)

(52) U.S. Cl.
CPC ..... *F24F 11/36* (2018.01); *F24F 11/61* (2018.01)

(58) Field of Classification Search
CPC ..... F25B 2500/22; F25B 2500/221; F25B 2500/23; F25B 2500/24; F25B 2500/32; F25B 2500/222; G01M 3/007; G01M 3/207; G01M 3/04
See application file for complete search history.

(56) References Cited

U.S. PATENT DOCUMENTS

| | | | | |
|---|---|---|---|---|
| 9,377,211 | B2 | 6/2016 | Yamashita et al. | |
| 9,459,013 | B2 | 10/2016 | Yamashita et al. | |
| 9,625,195 | B2 | 4/2017 | Hiraki et al. | |
| 10,094,605 | B2 | 10/2018 | Tanaka et al. | |
| 2012/0023989 | A1* | 2/2012 | Kinoshita | F24F 11/70 62/186 |
| 2013/0213068 | A1 | 8/2013 | Goel et al. | |

(Continued)

FOREIGN PATENT DOCUMENTS

| | | | | |
|---|---|---|---|---|
| JP | 2002228281 A | * | 8/2002 | F25D 21/12 |
| WO | 2017127450 | | 7/2017 | |

(Continued)

*Primary Examiner* — Nelson J Nieves
*Assistant Examiner* — Meraj A Shaikh
(74) *Attorney, Agent, or Firm* — Fletcher Yoder, PC

(57) ABSTRACT

A control system for a heating, ventilation, and/or air conditioning (HVAC) system includes a sensor configured to detect a concentration of refrigerant in air. The control system also includes a controller configured to receive feedback from the sensor indicative of the concentration of refrigerant in air, determine that the concentration of refrigerant in air is less than a threshold value, and determine that the HVAC system is in an operating mode. The controller is configured to operate a blower of the HVAC system for a predetermined time period based on the determinations that the concentration of refrigerant in air is less than the threshold value and that the HVAC system is in the operating mode.

26 Claims, 6 Drawing Sheets

(56) References Cited

U.S. PATENT DOCUMENTS

| | | | | |
|---|---|---|---|---|
| 2015/0159931 | A1* | 6/2015 | Okada | F24F 11/30 62/126 |
| 2016/0153697 | A1* | 6/2016 | Hamamoto | F25B 13/00 62/140 |
| 2016/0178229 | A1* | 6/2016 | Chen | F24F 11/70 62/56 |
| 2016/0348927 | A1 | 12/2016 | Endo et al. | |
| 2016/0363358 | A1 | 12/2016 | Papas et al. | |
| 2017/0284718 | A1 | 10/2017 | Suzuki et al. | |
| 2018/0043295 | A1* | 2/2018 | Friesen | B01D 53/04 |
| 2018/0073762 | A1* | 3/2018 | Yajima | F24F 11/89 |
| 2018/0094844 | A1* | 4/2018 | Suzuki | F25B 13/00 |
| 2018/0187917 | A1 | 7/2018 | Suzuki et al. | |
| 2018/0259235 | A1 | 9/2018 | Delgoshaei | |
| 2018/0299169 | A1* | 10/2018 | Suzuki | F24F 11/36 |
| 2020/0011580 | A1* | 1/2020 | Matsuda | F25B 13/00 |
| 2020/0049384 | A1* | 2/2020 | Asanuma | F25B 49/005 |
| 2020/0271344 | A1* | 8/2020 | Ikeda | F25B 49/005 |

FOREIGN PATENT DOCUMENTS

| | | |
|---|---|---|
| WO | 2017183234 | 10/2017 |
| WO | 2018187450 | 10/2018 |

* cited by examiner

SYSTEMS FOR REFRIGERANT LEAK DETECTION AND MANAGEMENT

CROSS-REFERENCE TO RELATED APPLICATIONS

This application claims priority from and the benefit of U.S. Provisional Application Ser. No. 62/808,098, entitled "SYSTEMS FOR REFRIGERANT LEAK DETECTION AND MANAGEMENT," filed Feb. 20, 2019, which is herein incorporated by reference in its entirety for all purposes.

BACKGROUND

The present disclosure relates generally to heating, ventilation, and/or air conditioning (HVAC) systems, and more particularly to systems for refrigerant leak detection and management in HVAC systems.

A wide range of applications exists for HVAC systems. For example, residential, light commercial, commercial, and industrial HVAC systems are used to control temperatures and air quality in residences and buildings. Generally, the HVAC systems may circulate a refrigerant through a refrigeration circuit between an evaporator, where the refrigerant absorbs heat, and a condenser, where the refrigerant releases heat. The refrigerant flowing within the refrigeration circuit is generally formulated to undergo phase changes within the normal operating temperatures and pressures of the system so that quantities of heat can be exchanged by virtue of the latent heat of vaporization of the refrigerant. As such, the refrigerant flowing within an HVAC system travels through multiple conduits and components of the refrigeration circuit. Inasmuch as refrigerant leaks compromise system performance or result in increased costs, it is accordingly desirable to provide detection and response systems for the HVAC system to reliably detect and respond to any refrigerant leaks of the HVAC system.

SUMMARY

In one embodiment of the present disclosure, a control system for a heating, ventilation, and/or air conditioning (HVAC) system includes a sensor configured to detect a concentration of refrigerant in air. The control system also includes a controller configured to receive feedback from the sensor indicative of the concentration of refrigerant in air, determine that the concentration of refrigerant in air is less than a threshold value, and determine that the HVAC system is in an operating mode. The controller is configured to operate a blower of the HVAC system for a predetermined time period based on the determinations that the concentration of refrigerant in air is less than the threshold value and that the HVAC system is in the operating mode.

In another embodiment of the present disclosure, a refrigerant leak management system for a heating, ventilation, and/or air conditioning (HVAC) system includes a sensor configured to detect a concentration of refrigerant in air, a timer, and a controller including a processor that is communicatively coupled to the sensor and the timer. The controller is configured to receive feedback from the sensor indicative of the concentration of refrigerant in air and determine that the concentration of refrigerant in air is less than a threshold value. The controller is also configured to determine that the HVAC system is in an operating mode and instruct the timer to monitor an elapsed time until the elapsed time reaches a predetermined time period. Further, the controller is configured to operate a blower of the HVAC system for the predetermined time period based on the determinations that the concentration of refrigerant in air is less than the threshold value and that the HVAC system is in the operating mode.

In a further embodiment of the present disclosure, a heating, ventilation, and/or air conditioning (HVAC) system includes a sensor configured to detect a concentration of refrigerant in air, a blower configured to direct conditioned air to a conditioned space, and a controller. The controller is configured to receive feedback from the sensor indicative of the concentration of refrigerant in air, determine that the concentration of refrigerant in air is less than a threshold value, and determine that the HVAC system is in an operating mode. The controller is also configured to operate a blower of the HVAC system for a predetermined time period based on the determinations that the concentration of refrigerant in air is less than the threshold value and that the HVAC system is in the operating mode. Additionally, the controller is configured to resume normal operation of the HVAC system after operating the blower for the predetermined time period.

Other features and advantages of the present application will be apparent from the following, more detailed description of the embodiments, taken in conjunction with the accompanying drawings which illustrate, by way of example, the principles of the application.

DETAILED DESCRIPTION

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to a refrigerant leak detection and management system for HVAC systems. As discussed above, to condition the interior space of a building, an HVAC system generally includes a refrigerant flowing within a refrigeration circuit. However, the refrigerant may inadvertently leak from a flow path of the refrigeration circuit due to wear or degradation of components, or imperfect joints or connections within the refrigeration circuit, at some point after installation of the HVAC system. If undetected, leaking refrigerant may compromise system performance or result in increased costs. For example, under certain conditions, leaking refrigerant vaporizes and discharges outward from a source of the leak, which can result in refrigerant-containing air accumulating, for example, within a casing of an HVAC unit.

With the foregoing in mind, present embodiments are directed to a leak management system implemented in an air handling enclosure of an HVAC system, such as an air handling unit of a residential HVAC system or an air handling portion of a packaged HVAC system. More specifically, a controller communicatively coupled to a blower within the air handing enclosure may instruct the blower to circulate or displace air surrounding a heat exchanger in the air handling enclosure to dilute any leaking refrigerant. To purge the air within the air handling enclosure, the controller may activate the blower for a predetermined time period before enabling normal operation of the HVAC system, after the HVAC system has been inactive for a threshold time, and/or in response to a sensor detecting refrigerant within the surrounding air, as discussed in more detail herein. As such, present techniques enable HVAC systems to reliably detect, mitigate, and manage refrigerant leaks to improve operation and reduce costs for the HVAC systems.

Figure 1:
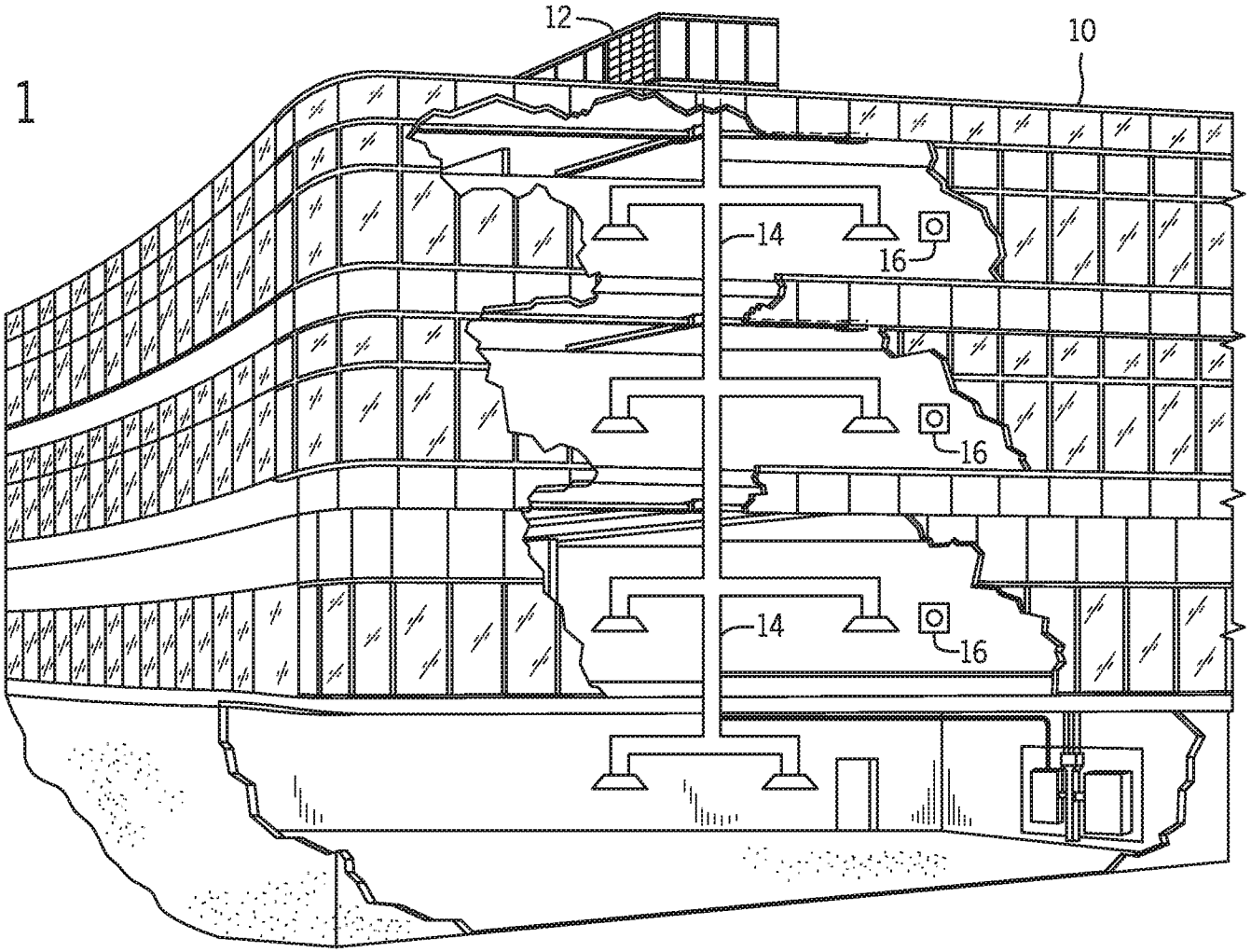
FIG. 1 is a perspective view of an embodiment of a commercial or industrial HVAC system, in accordance with an aspect of the present disclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
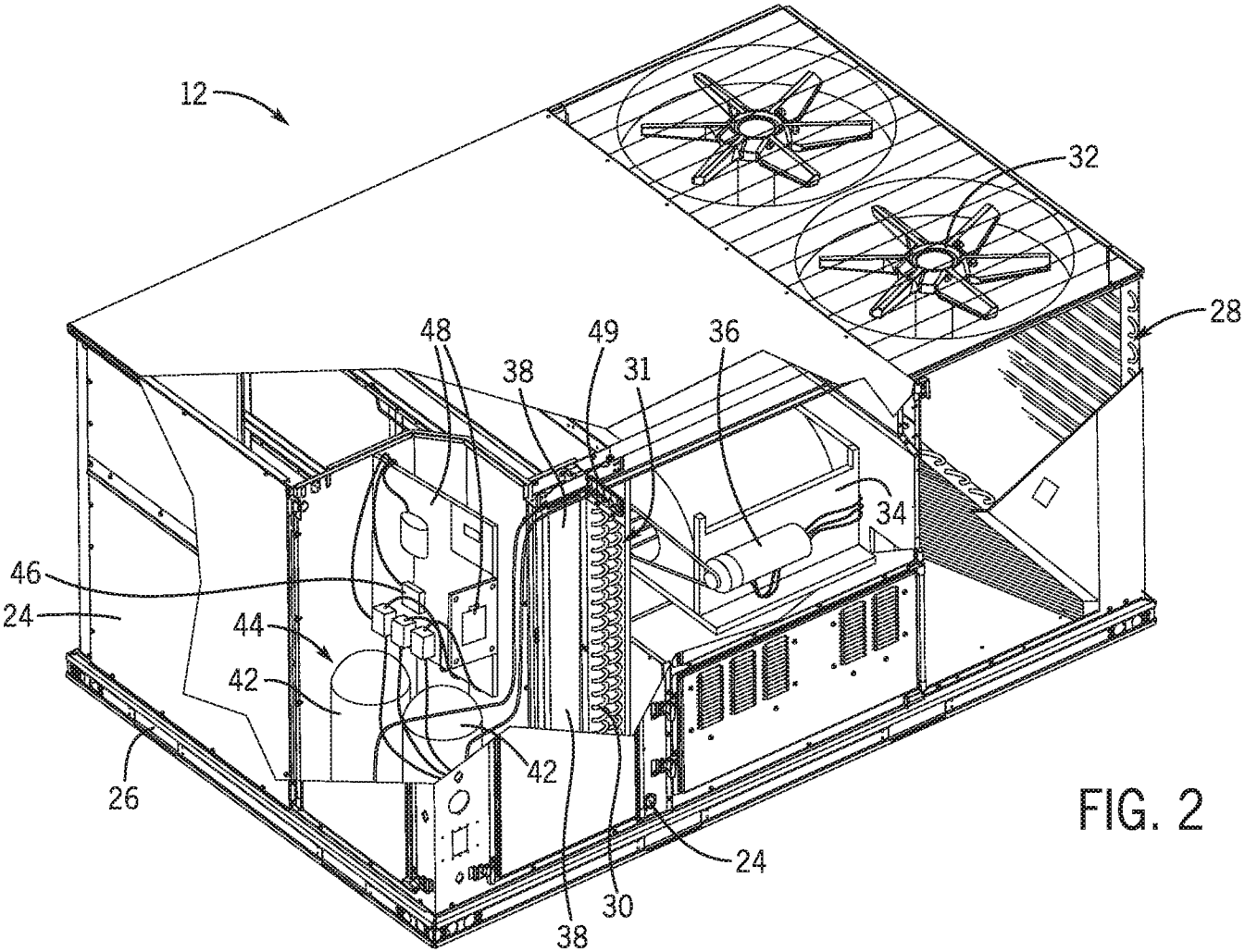
FIG. 2 is a perspective cutaway view of an embodiment of a packaged unit of an HVAC system, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
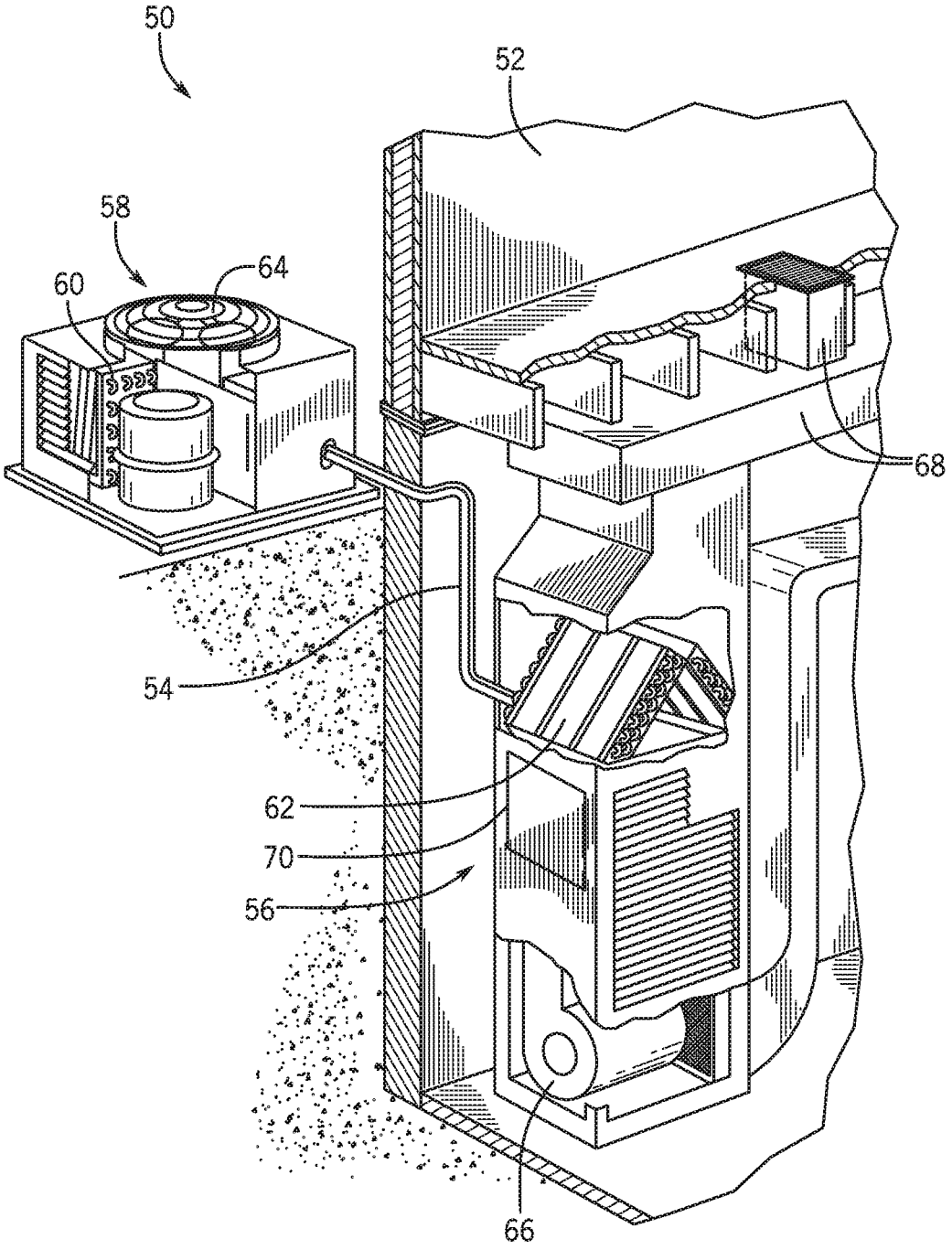
FIG. 3 is a perspective cutaway view of an embodiment of a split system of an HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
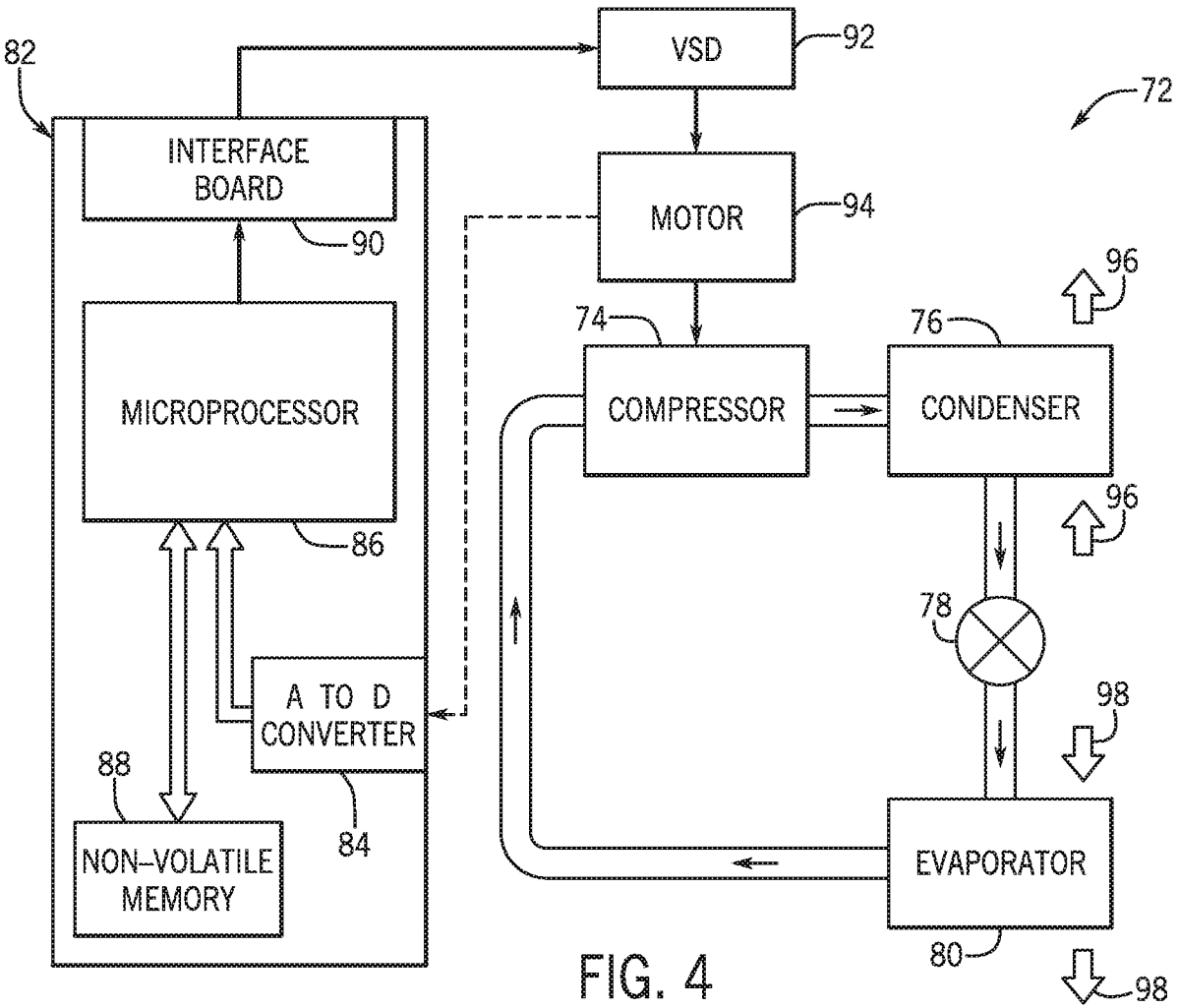
FIG. 4 is a schematic diagram of an embodiment of a vapor compression system of an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
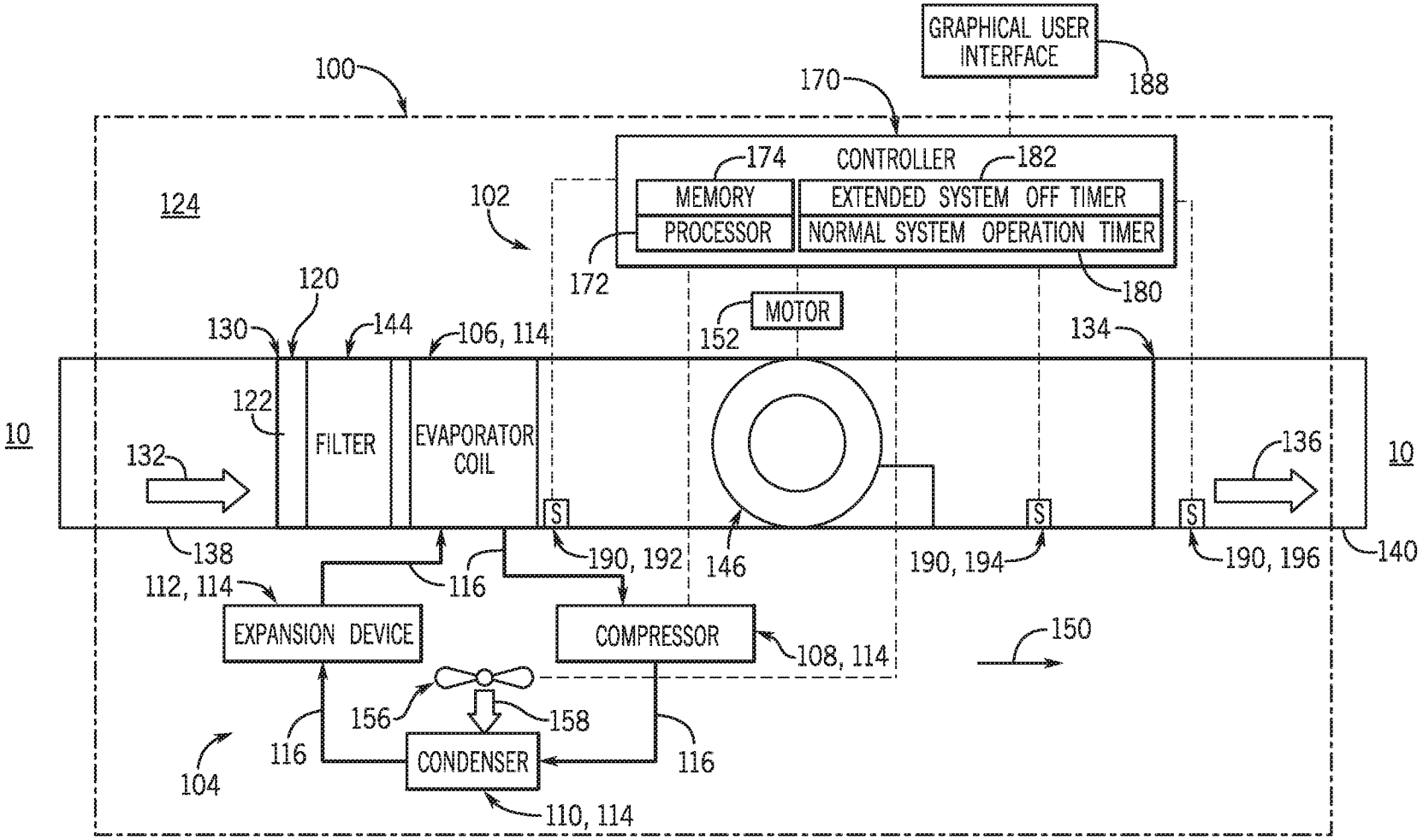
FIG. 5 is a schematic diagram of an embodiment a leak management system of an HVAC system, in accordance with an aspect of the present disclosure.

FIG. 5 is a schematic diagram of an HVAC system 100 having a leak management system 102 for detecting, mitigating, and/or controlling a concentration of leaked refrigerant within the HVAC system 100 and/or a building, such as the building 10 discussed above. As shown, the HVAC system 100 includes a refrigeration circuit 104 having an evaporator coil 106 fluidly coupled with a compressor 108, a condenser 110, and an expansion device 112, collectively referred to herein as refrigerant circuit components or components 114. A refrigerant 116 flows between the components 114, undergoing phase changes that enable the HVAC system 100 to condition an interior space or conditioned space of the building 10. The refrigerant 116 may be any suitable refrigerant, such as R134a, R410a, R32, R1234ze, R1234yf, R-454A, R-454C, R-455A, R-447A, R-452B, R-454B, and the like. Each of the components 114 may respectively operate similar to the previously-introduced evaporators, condensers, compressors, and expansion devices discussed above with reference to FIGS. 1-4. Moreover, the components 114 may be part of any suitable residential refrigeration system, commercial refrigeration system, split refrigeration system, and/or single unit refrigeration system. As will be discussed in more detail below, the leak management system 102 may be a control system configured to prevent or block accumulation of a leaked amount of the refrigerant 116 from the refrigeration circuit 104, as well as to perform suitable control actions to mitigate a detected leak of the refrigerant 116.

Additionally, the illustrated embodiment of the HVAC system 100 in FIG. 5 includes the evaporator coil 106 disposed within an enclosure 120 of the HVAC system 100. The enclosure 120 is generally an air handling enclosure or air handler of the HVAC system 100, such as an indoor unit. Additionally, the enclosure 120 is a structurally strong and/or rigid container or box having walls that fluidly isolate an interior 122 of the enclosure 120 from an exterior 124 of the enclosure 120. In some embodiments, the fluid separation between the interior 122 and the exterior 124 may be air-tight, though in other embodiments, air flow may occur across seams, joints, gaskets, or other features of the enclosure 120. Moreover, in certain embodiments, the enclosure 120 is disposed in an attic, in a supply or utility room, on a roof or wall of a building, or in another suitable location to enable conditioning of the interior space of the building 10.

The disclosed embodiment of the enclosure 120 includes openings that serve as inlets or outlets for air flow therethrough. For example, as illustrated in FIG. 5, the enclosure 120 includes a return inlet 130 for receiving a return air flow 132, as well as a supply outlet 134 for directing a conditioned air flow 136 to the interior space of the building 10. Additionally, to respectively direct the air to and from the enclosure 120, the HVAC system 100 includes a return inlet duct 138 coupled to the return inlet 130 and a supply outlet duct 140 coupled to the supply outlet 134. In general, the ducts 138, 140 are passageways that fluidly connect the interior 122 of the enclosure 120 to various locations inside or outside of the building 10.

As illustrated in the embodiment of FIG. 5, the return air flow 132, which includes air from the interior space of the building 10, is directed into the enclosure 120 along the return inlet duct 138 and the return inlet 130. Additionally, in some embodiments, the return air flow 132 may include outside air that is mixed with the air from the interior space of the building 10. In the embodiment illustrated in FIG. 5, the return air flow 132 travels through multiple components within the enclosure 120. For example, the return air flow 132 travels through a filter 144 that removes particulates, dust, bacteria, or other undesired matter within the return air flow 132. In certain embodiments, the return air flow 132 also travels through a heating coil or other suitable components that heat the return air flow 132 to remove humidity or otherwise condition the return air flow 132. Further, when actuated, a supply fan or blower 146 disposed within the enclosure 120 pulls the return air flow 132 at an increased speed and/or flowrate through the enclosure 120. The blower 146 of the HVAC system 100 receives power from a motor 152. In certain embodiments, the blower 146 is powered by a variable speed drive (VSD), such as the VSD 92 discussed above, for variable control of fan speeds. In other embodiments, the motor 152 operates at a fixed speed sufficient for conditioning the interior space of the building 10.

When activated, the blower 146 therefore operates to pull the return air flow 132 over the evaporator coil 106. When the compressor 108 is operating, the evaporator coil 106 may therefore cool the return air flow 132 and/or remove dissolved moisture, such as humidity, from the return air flow 132 by enabling heat transfer between the refrigerant 116 and the return air flow 132. The return air flow 132 is, therefore, conditioned and transformed into the conditioned air flow 136 that travels along an air flow direction 150 out of the supply outlet 134 and to the interior space of the building 10. In other embodiments, the evaporator coil 106 may be disposed downstream of the blower 146 relative to the air flow direction 150 though the enclosure 120. In any case, operating the blower 146 may effectively discharge the air within the enclosure 120 and replace the air with a fresh amount of the return air flow 132.

Additionally, although discussed herein with reference to the coil 106 being an evaporator coil, it should be understood that the presently disclosed HVAC system 100 may be a heat pump system having a reversing valve, in some embodiments. As such, in these embodiments, the reversing valve may be actuated to change a flow direction of the refrigerant 116 within the refrigerant circuit 104 from a first direction to a second direction, opposite of the first direction. Thus, with the refrigerant 116 flowing in the appropriate direction, the coil 106 may alternatively operate as a condenser coil that provides heat to condition the return air flow 132 into the heated, conditioned air flow 136.

Moreover, outside the enclosure 120, an outdoor fan 156 of the HVAC system 100 is disposed adjacent to the condenser 110 to direct a flow of outside air 158 across the condenser 110. The outdoor fan 156 enables a high pressure gas flow of the refrigerant 116 traveling within the condenser 110 to release thermal energy to the outside air 158 and condense into a high pressure liquid refrigerant flow, thereby restoring the refrigerant 116 for further generation of the conditioned air flow 136 via the evaporator 106. Moreover, in embodiments in which the HVAC system 100 is a heat pump system, the condenser 110 may alternatively operate as an evaporator when the coil 106 is operating as a condenser coil.

In the embodiment illustrated in FIG. 5, the leak management system 102 includes a controller 170 to control operations therein. Additionally, for the illustrated embodiment, the controller 170 is the HVAC controller that governs operation of the entire HVAC system 100, including the compressor 108, blower 146, the outdoor fan 156, and more, in addition to the leak management system 102. The controller 170 may include a distributed control system (DCS) or any computer-based workstation. For example, the controller 170 can be any device employing a general purpose or an application-specific processor 172, both of which may generally include memory 174 or suitable memory circuitry for storing instructions and/or data. However, in certain embodiments, the controller 170 may be a separate controller for controlling the leak management system 102 that is communicatively coupled to exchange data and/or instructions with an HVAC controller or another suitable master controller.

The processor 172 illustrated in FIG. 5 may include one or more processing devices, and the memory 174 may include one or more tangible, non-transitory, machine-readable media collectively storing instructions executable by the processor 172 to control the leak management system 102 and/or the HVAC system 100. The processor 172 of the controller 170 provides control signals to operate the leak management system 102 and the HVAC system 100 to perform the control actions disclosed herein. More specifically, as discussed below, the controller 170 is communicatively coupled to receive input signals from various components of the HVAC system 100, as well as to output control signals that control and communicate with the various components. The controller 170 may provide suitable control signals to control the flowrates, motor speeds, and valve positions, among other parameters, of the HVAC system 100.

The leak management system 102 also includes a normal system operation timer 180 and an extended system-off timer 182, each communicatively coupled to the processor 172 of the controller 170. Generally, the normal system operation timer 180 measures an elapsed time to enable the controller 170 to determine how long the blower 146 has been operating while the HVAC system 100 is in an operating mode, and the extended system-off timer 182 measures an elapsed time to enable the controller 170 to monitor how long the blower 146 has been operating while the HVAC system 100 is in a non-operating mode. The extended system-off timer 182 may further enable to the controller to monitor an elapsed time that the HVAC system 100 has been in the non-operating mode. The timers 180, 182 may each be any suitable electromechanical, electronic, or mechanical devices suitable for monitoring elapsed time. As discussed in more detail below, the controller 170 may take certain control actions based on a certain elapsed time monitored by one or both of the timers 180, 182. However, in other embodiments, the timers 180, 182 may be time switches that directly activate or deactivate any suitable components of the HVAC system 100 via switching devices coupled to timing circuitry or devices. In some of these embodiments, the timers 180, 182 may provide redundancy to operation of the HVAC system 100. For example, the timers 180, 182 may directly activate the blower 146 in response to certain conditions, while enabling the controller 170 to activate the blower 146 under normal operating conditions. It should further be understood that the timers 180, 182 may alternatively be a single timer or time switch with dual timing functionality and/or may be external components that are communicatively coupled to the controller 170. Moreover, as used herein, reference to a timer 180, 182 that monitors time refers to embodiments in which the timer 180, 182 provides any suitable indication or measure to the controller 170 suitable for control purposes.

Although the controller 170 has been described as including the processor 172, the memory 174, and the timers 180, 182, it should be understood that the controller 170 may include or be communicatively coupled to a number of other computer system components. These other computer system components may enable the controller 170 to control the operations of the HVAC system 100 and the related components. For example, the controller 170 may include a communication component that enables the controller 170 to communicate with other computing systems and electronic devices, such as alarm systems. The controller 170 may also include an input/output component that enables the controller 170 to interface with users via a graphical user interface 188 or the like. In addition, the communication between the controller 170 and other components of the HVAC system 100 may be via a wireless connection, such as a connection through Bluetooth® Low Energy, ZigBee®, WiFi®, or may be a wired connection, such as a connection through Ethernet. In some embodiments, the controller 170 may include a laptop, a smartphone, a tablet, a personal computer, a human-machine interface, or the like. Additionally, the embodiments disclosed herein may be at least partially embodied using hardware implementations. For example, logic elements of the controller 170 may include a field-programmable gate array (FPGA) or other specific circuitry.

Moreover, the present embodiment of the leak management system 102 includes concentration sensors 190 configured to detect a concentration of refrigerant in air, thereby facilitating management of leaks of the refrigerant 116. As shown in the embodiment in FIG. 5, the concentration sensors 190 include a first concentration sensor 192 disposed within the enclosure 120 near or proximate the evaporator coil 106, a second concentration sensor 194 disposed within the enclosure 120 near or proximate the blower 146, and a third concentration sensor 196 disposed within the supply outlet duct 140. In more detail, the concentration sensors 190 are communicatively coupled to the controller 170 and are configured to transmit sensor signals to the controller 170 indicative of a concentration of the refrigerant 116 that may have leaked into the interior 122 of the enclosure 120 or within the supply outlet duct 140. As discussed herein, the concentration sensors 190 are generally disposed proximate and/or within the enclosure 120 to enable the concentration sensors 190 to monitor potential leaks of the refrigerant 116 from the evaporator coil 106, connections to the evaporator coil 106, or other components of the refrigeration circuit 104.

As illustrated in the embodiment of FIG. 5, the first concentration sensor 192 is disposed downstream of the evaporator coil 106 relative to the air flow direction 150 through the enclosure 120 when the conditioned air flow 136 is supplied to the conditioned space. In other embodiments, the first concentration sensor 192 is disposed upstream of the evaporator coil 106 or in another location suitable for sensing the concentration of the refrigerant 116, such as below or beneath the evaporator coil 106. When disposed proximate the evaporator coil 106, it is presently recognized that the first concentration sensor 192 is closer to a greater quantity of braze joints, solder joints, or other potential sources of leaks of the refrigerant 116 from the evaporator coil 106, thus enhancing detection of the refrigerant leaks. Additionally, as illustrated, the second concentration sensor 194 is downstream of the blower 146 relative to the air flow direction 150 through the enclosure 120 to enable detection of the concentration of the refrigerant 116 during operation of the blower 146.

Although three concentration sensors 190 are discussed herein, any suitable number of concentration sensors 190 may be included proximate the evaporator coil 106, the enclosure 120, the ducts 138, 140, and/or the interior space of the building 10. For example, in certain embodiments having multiple concentration sensors 190 proximate the HVAC system 100, the controller 170 may be configured to triangulate, locate, or pinpoint a position of a refrigerant leak via the signals received from the multiple concentration sensors 190. It should also be understood that, in certain embodiments, the concentration sensors 190 may be omitted, and the leak management system 102 may operate as a feedforward system that operates to prevent or mitigate accumulation of the refrigerant 116 without input from sensors. Additionally, as used herein, a respective concentration sensor 190 is "proximate" or near an element when the respective concentration sensor 190 is capable of measuring a concentration of the refrigerant 116 within sensing range of the element, disposed inside of the element, disposed adjacent to the element, disposed within a threshold distance of the element, and/or disposed within inches or feet of the element.

The concentration sensors 190 may be any suitable type of concentration sensors, including electrochemical gas detectors, catalytic bead sensors, photoionization detectors, infrared point sensors, infrared imaging sensors, semiconductor sensors, ultrasonic gas detectors, holographic gas sensors, or any other suitable concentration sensor capable of detecting a concentration of the refrigerant 116. Moreover, although discussed herein as having concentration sensors 190, the leak management system 102 may, additionally or alternatively, include other sensors suitable for detecting a presence of the refrigerant 116 within the enclosure 120, such as temperature sensors, pressure sensors, acoustic sensors, flowrate sensors, and so forth. Accordingly, with the above understanding of the components of the leak management system 102, the example embodiments of operation of the leak management system 102 to block or prevent accumulation of the refrigerant 116 within the enclosure 120 discussed below may be more readily understood.

Figure 6:
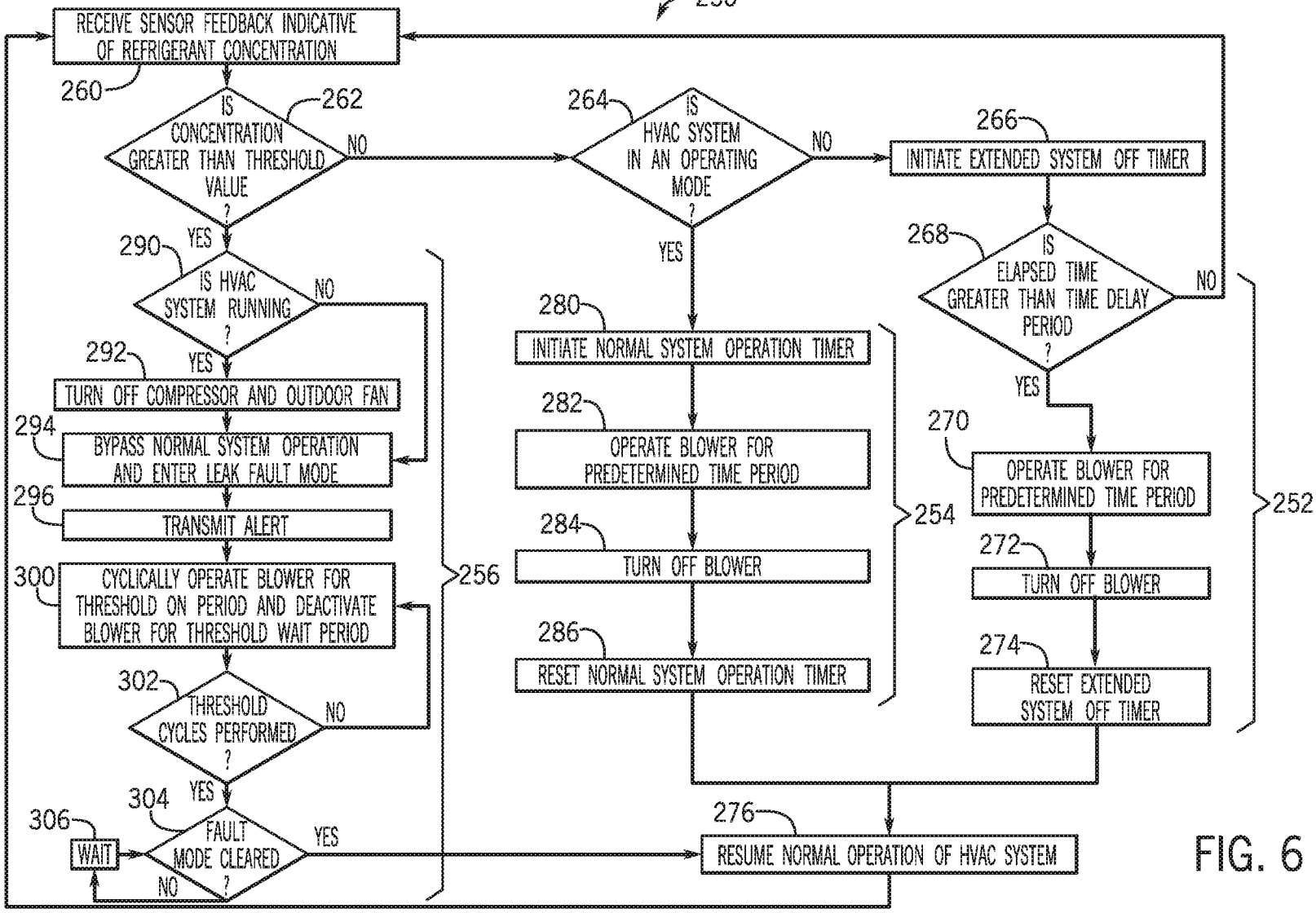
FIG. 6 is a flow diagram representing an embodiment of a process of operating the leak management system of FIG. 5, in accordance with an aspect of the present disclosure.

With the above description of the HVAC system 100 having the leak management system 102 in mind, FIG. 6 is a flow diagram illustrating an embodiment of a process 250 for operating the leak management system 102 of FIG. 5. It is to be understood that the steps discussed herein are merely exemplary, and certain steps may be omitted or performed in a different order than the order discussed herein. The process 250 may be performed by the controller 170 via one or more processors, such as the processor 172 of the controller 170, an additional processor, or a combination thereof. Generally, the process 250 provides an efficient control strategy that enables the leak management system 102 to effectively purge the air, which may contain leaked refrigerant 116, from the enclosure 120 of the HVAC system 100 in response to certain conditions being satisfied. For example, the leak management system 102 may purge the enclosure 120 after the HVAC system 100 has been inactive for a predetermined time period, before the HVAC system 100 performs a normal operation or enters a normal operating mode, and/or in response to a detected leak of the refrigerant 116. Accordingly, in the illustrated embodiment of the process 250, the controller 170 may perform one or multiple of three mitigation sub-processes, including a system-off purge sub-process 252, a system-on purge sub-process 254, and a leak detected sub-process 256.

Looking now to the steps illustrated herein, the present embodiment of the process 250 includes the controller 170 receiving, at block 260, sensor feedback indicative of a refrigerant concentration from one or more of the concentration sensors 190. That is, the controller 170 of the leak management system 102 receives sensor signals from the concentration sensors 190 indicative of a concentration of the refrigerant 116 that may have leaked from the refrigeration circuit 104 and into the enclosure 120 or the ducts 138, 140. Then, based on the signals, the controller 170 determines the concentration of the refrigerant 116. Additionally, in some embodiments, the concentration sensors 190 provide binary signals indicative of whether a threshold amount of the refrigerant 116 is detected or is not detected. For example, during operation of the HVAC system 100, a leak of the refrigerant 116 may not be present. Thus, if no leak of the refrigerant 116 is present, the controller 170 may determine that the concentration of the refrigerant 116 is below a lower detection limit of the concentration sensors 190. However, if refrigerant 116 leaks from the evaporator coil 106 and is sensed by the concentration sensors 190, the controller 170 receives the one or more signals from the concentration sensors 190 and determines a non-zero concentration of the refrigerant 116 within the enclosure 120 or the ducts 138, 140. In some embodiments, the controller 170 may determine whether the refrigerant 116 has leaked based on signals received from one concentration sensor 190, a threshold number of the concentration sensors 190, every concentration sensor 190, and so forth.

Based on the sensor signals, the controller 170 following the process 250 determines, at block 262, whether the concentration of the refrigerant 116 is greater than a predetermined concentration threshold. The predetermined concentration threshold may be a user-set, technician-set, manufacturer-set, or distributor-set value that is stored within the memory 174 of the controller 170, either before or after the controller 170 is placed into operation within the HVAC system 100. In some embodiments, the predetermined concentration threshold may be set as the lower detection limit of the concentration sensors 190.

In response to a determination that the concentration of the refrigerant 116 is less than the predetermined concentration threshold, the controller 170 determines, at block 264, whether the HVAC system 100 is in an operating mode. In general, the HVAC system 100 is configured to switch between an operating mode or ON-cycle, in which the compressor 108 forces the refrigerant 116 through the refrigeration circuit 104 to condition the interior space, and a non-operating mode or an OFF-cycle, in which the compressor 108 does not motivate the refrigerant 116 through the refrigeration circuit 104. As such, the controller 170 may determine that the HVAC system 100 is in an operating mode when a call for cooling, heating, ventilation, and/or dehumidification is made but unmet or unsatisfied. That is, the operating mode may be a cooling mode, a heating mode, a ventilation mode, a dehumidification mode, a cooling and dehumidification mode, and so forth. Similarly, the controller 170 may determine that the HVAC system 100 is in a non-operating mode when the call for cooling, heating, ventilation, and/or dehumidification is satisfied, such that the blower 146, the compressor 108, and the outdoor fan 156 are inactive.

In response to a determination that the HVAC system 100 is in a non-operating mode, the controller 170 initiates, at block 266, the extended system-off timer 182, thereby beginning the system-off purge sub-process 252. As discussed herein, the system-off purge sub-process 252 enables the leak management system 102 to block or prevent accumulation of the refrigerant 116 within the air of the enclosure 120 by selectively operating the blower 146 after extended non-operating periods of the HVAC system 100. As such, the extended system-off timer 182 monitors an amount of time that has elapsed since the HVAC system 100 has been in a non-operating mode. The controller 170 following the process 250 may therefore determine, at block 268, based on input from the extended system-off timer 182, whether the elapsed time monitored by the extended system-off timer 182 is greater than a time delay period or threshold wait time. The time delay period may be any suitable period of time, such as 1 hour, 2 hours, 4 hours, 8 hours, and so forth.

In response to a determination that the time delay period has not been reached, the controller 170 returns to block 260 to continue receiving the sensor feedback indicative of refrigerant concentration in air within the enclosure 120. In some embodiments, the controller 170 and the concentration sensors 190 may also wait a predetermined amount of time before determining the concentration of the refrigerant 116 again, thus enhancing a useable life of the concentration sensors 190 and/or reducing usage of computing power by the controller 170. In certain embodiments, the predetermined amount of time is set as 1 minute, 5 minutes, 10 minutes, 60 minutes, or more.

Alternatively, in response to a determination that the time delay period set forth by the extended system-off timer 182 has been reached or exceeded, the controller 170 following the process 250 operates, at block 270, the blower 146 for a predetermined time period. The predetermined time period may be any suitable length of time that is selected to enable the blower 146 to purge air from the enclosure 120. For example, the predetermined time period may be based on an exchange rate of the blower 146, which may be based on a volume of air moved by the blower 146 and a volume of the enclosure 120 and the supply outlet duct 140 coupled thereto. In some embodiments, the predetermined time period is 1 minute, 3 minutes, 5 minutes, or any other suitable length of time. Accordingly, by purging the enclosure 120 of air, the leak management system 102 may block or prevent any leak of the refrigerant 116 having a refrigerant concentration that is not yet detected by one or more of the concentration sensors 190 from accumulating within the enclosure 120. Moreover, by waiting until the time delay period has been reached or exceeded before purging the enclosure 120, the leak management system 102 conserves power usage by the blower 146.

For verification purposes, in some embodiments, the controller 170 may additionally receive feedback from the motor 152 driving the blower 146 to confirm that the blower 146 is operating as instructed. In embodiments in which the blower 146 is a fixed-speed blower, the controller 170 may instruct the blower 146 to operate at its fixed or maximum speed. In other embodiments, in which the blower 146 is a variable speed blower, the controller 170 may instruct the blower 146 to operate at any suitable speed for any suitable predetermined time period that causes the air within the enclosure 120 to be replaced by the return air flow 132. For example, the controller 170 may instruct the blower 146 to operate at a relatively longer predetermined time period at a lower speed, in embodiments in which the blower 146 is a variable-speed blower.

Then, the controller 170 proceeds to turn off, at block 272, the blower 146 and reset, at block 274, the extended system-off timer 182. Accordingly, the leak management system 102 has completed the system-off purge sub-process 252, and the controller 170 may resume, at block 276, normal operation of the HVAC system 100. In embodiments in which any call for cooling, heating, ventilation, and/or dehumidification remains satisfied, the controller 170 may instruct the HVAC system 100 to return to the non-operating mode. The controller 170 may therefore return to block 260 to continue receiving the sensor feedback indicative of the refrigerant concentration in the enclosure 120.

As another aspect of the process 250, in response to determining, at block 262, that the concentration of the refrigerant 116 in the enclosure 120 is less than the threshold value and alternatively determining that the HVAC system 100 is in an operating mode, at block 264, the controller 170 may initiate, at block 280, the normal system operation timer 180. This initiation may be the first step of the system-on purge sub-process 254, in some embodiments. As discussed herein, the system-on purge sub-process 254 enables the leak management system 102 to purge any accumulated refrigerant 116 in the air from within the enclosure 120 before the HVAC system 100 performs normal conditioning operations. Thus, in response to the determinations of blocks 262 and 264, the controller 170 instructs, at block 282, the blower 146 to operate for a predetermined time period, as monitored by the normal system operation timer 180. The operation of the blower 146 at block 282 may be similar to the operation of the blower 146 at block 270, as discussed above. However, it should be understood that the predetermined time period of block 282 may different from or substantially similar to the predetermined time period of block 270. For example, the predetermined time period of block 282 may also be 1 minute, 3 minutes, 5 minutes, or any other suitable length of time. Accordingly, the leak management system 102 purges the air from the enclosure 120, desirably blocking or preventing accumulation of leaked refrigerant 116 within the enclosure 120 that may otherwise reach concentrations that can be sensed by the concentration sensors 190.

Then, the controller 170 proceeds to turn off, at block 284, the blower 146 and reset, at block 286, the normal system operation timer 182. Accordingly, the leak management system 102 completes the system-on purge sub-process 254, and the controller 170 resumes, at block 276, normal operation of the HVAC system 100. In some embodiments, if a requested normal operation of the HVAC system 100 utilizes the blower 146, the blower 146 may remain on after block 282, such that block 284 is bypassed. As mentioned above, the controller 170 then returns to block 260 to continue receiving the sensor feedback from the concentration sensors 190.

As another aspect of the process 250, in other situations, the controller 170 may determine, at block 262, that the concentration of the refrigerant 116 in the enclosure 120 is greater than the threshold value. In other words, the controller 170 may determine that a leak of the refrigerant 116 is present or has occurred. In such cases, the controller 170 following the process 250 determines, at block 290, whether the HVAC system 100 is operating as the first step of the leak detected sub-process 256. As discussed herein, the leak detected sub-process 256 enables the leak management system 102 to mitigate the leak of the refrigerant 116 by selectively operating the blower 146 and performing any other suitable control actions.

For example, in response to a determination that the HVAC system 100 is operating, the controller turns off, at block 292, the compressor 108 and the outdoor fan 156, thereby deactivating the refrigerant circuit 104 that may otherwise cause the refrigerant 116 to leak further. The controller 170 also bypasses, at block 294, normal system operation and enters a fault mode or detected leak mode. In embodiments in which the controller 170 determines at block 290 that the HVAC system 100 is not operating, the controller 170 may alternatively continue directly to block 294 to bypass the normal system operation and enter the fault mode. In some embodiments, the controller 170 may also receive input from the motor 152 to verify the blower 146 is operating and/or receive input from other components of the HVAC system 100 to verify that the compressor 108 and the outdoor fan 156 are not operating.

Following through the leak detected sub-process 256, the controller 170 also transmits, at block 296, an alert indicative of the detected leak of the refrigerant 116. For example, the controller 170 may transmit a control signal to instruct a device, such as the graphical user interface 188, a thermostat, a user device, and/or a service technician workstation, to generate an alert indicative of the detected refrigerant leak. In some embodiments, the alert also includes instructions to deactivate activation sources and/or to instruct users to respond appropriately. Once informed of the detected refrigerant leak, users may perform manual control actions, such as shutting off the HVAC system 100, manually resetting the HVAC system 100, or repairing a portion of the evaporator coil 106, in response to the detected refrigerant leak Moreover, the leak management system 102 having the controller 170 may modify operation of the HVAC system 100 to mitigate the detected refrigerant leak. For example, the controller 170 may cyclically operate, at block 300, the blower 146 for a threshold on period and deactivate the blower 146 for a threshold wait period. In some embodiments, the threshold on period may be 1 minute, 3 minutes, or 5 minutes, and the threshold off period may be 3 minutes, 5 minutes, or 10 minutes. As such, the blower 146 motivates refrigerant-containing air within the enclosure 120 to be diluted within the interior space of the building 10. The controller 170 additionally determines, at block 302, whether a threshold number of cycles have been performed via block 300. For example, in some embodiments, the threshold number of cycles is set to three cycles. In response to a determination that the threshold number of cycles have not been performed, the controller 170 returns to block 300 and again cycles operation of the blower 146 for the threshold on period and threshold wait period. In other embodiments, block 302 may be omitted, and the controller 170 may directly instruct the blower 146 to perform a predetermined number of cycles with the blower 146 activated for the threshold on period and deactivated for the threshold wait period. In any case, waiting for the threshold wait period to pass before activating the blower 146 for the threshold on period may improve dissipation of the leak of the refrigerant 116 while effectively conserving use of power supplied to the blower 146.

Moreover, in some embodiments, the controller 170 may escalate its control actions over the cycles in response to a determination that the detected concentration of the refrigerant 116 is not diminishing. For example, in embodiments in which the blower 146 is the variable-speed blower, the controller 170 may instruct the blower 146 to operate at a first speed during a first cycle, determine that the concentration of the refrigerant 116 or a rate of change of the concentration of the refrigerant 116 has not lowered to a target value, and then instruct the blower 146 to operate at a second speed that is greater than the first speed for any remaining cycles.

Following the process 250, the controller 170 may determine, at block 304, whether the fault mode has been cleared.

In some embodiments, the controller 170 may clear the fault mode in response to a stop condition being satisfied. The stop condition may be satisfied when the threshold number of cycles is performed, when the detected concentration of the refrigerant 116 is mitigated, when the fault mode is manually cleared, when input indicative of a manual reset is received, and so forth. For example, in some embodiments, the controller 170 may prevent or block the HVAC system 100 from operating until after the controller 170 determines that the concentration of the refrigerant 116 is again within the predetermined concentration threshold. Additionally, in some embodiments, the controller 170 may clear the fault mode after determining that the detected refrigerant leak is repaired based on user input received through the graphical user interface 188.

In response to a determination that the fault mode has been cleared, the controller 170 may exit the leak detected sub-process 256 and resume, at block 276, normal operation of the HVAC system 100. As mentioned above, the controller 170 then returns to block 260 to continue receiving the sensor feedback from the concentration sensors 190. If the fault mode is not cleared, the controller may wait, at block 306, for a threshold period of time before determining again whether the fault mode has been cleared at block 304. As such, embodiments of the HVAC system 100 that include the disclosed leak management system 102 are able to effectively and efficiently purge the leaked refrigerant from the enclosure 120.

Moreover, the controller 170 may continuously receive sensor signals and determine whether the concentration is greater than the threshold, in some embodiments. As such, should a leak be detected while the controller 170 is performing the system-off purge sub-process 252 or the system-on purge sub-process 254, the controller 170 may terminate any remaining steps of the respective sub-process 252, 254 and proceed directly to block 290 to more rapidly mitigate and dilute potential leaks of the refrigerant 116. In other embodiments, the controller 170 may complete the respective sub-process 252, 254 and then proceed directly to block 290. Moreover, in embodiments of the leak management system 102 without the concentration sensors 190, the process 250 may exclude block 262 and the leak detected sub-process 256, thereby enabling the leak management system 102 to use feedforward control to purge the enclosure 120 via the sub-processes 252, 254.

Accordingly, the present disclosure is directed to a leak management system 102 for detecting and mitigating leaks of the refrigerant 116 from the refrigerant circuit 104 of the HVAC system 100, while also averting accumulation of the refrigerant 116 within the enclosure 120 of the HVAC system 100. Generally, the controller 170 of the leak management system 102 is configured to operate the blower 146 within the enclosure 120 after the HVAC system 100 has been in a non-operating mode for a predetermined time period, effectively diluting any refrigerant 116 that may have leaked from the refrigerant circuit 104. Additionally, the controller 170 is configured to operate the blower 146 for a predetermined time period before allowing normal operation of the HVAC system 100, thereby diluting any leaks of the refrigerant 116 before the compressor 108 and other components of the HVAC system 100 are activated. The leak management system 102 also includes concentration sensors 190 that enable the controller 170 to monitor the concentration of the refrigerant 116 in air and determine whether the concentration exceeds a predetermined concentration threshold indicative of a refrigerant leak. In response to refrigerant leak detection, the controller 170 may provide control signals to modify operation of the HVAC system 100 and/or the leak management system 102. For example, the controller 170 may suspend operation of the compressor 108 and the outdoor fan 156, transmit an alert, and/or cyclically operate the blower 146 to dilute the refrigerant 116 within the enclosure 120. By cyclically operating the blower 146 to be on for a threshold on period and off for a threshold wait period, the controller 170 may effectively mitigate the leak of the refrigerant 116 with a reduced power consumption compared to embodiments that may operate the blower 146 continuously. In these manners, the leak management system 102 enables the detection and mitigation of refrigerant leaks substantially before the refrigerant 116 may reach undesired concentrations in the air of the enclosure 120.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A control system for a heating, ventilation, and/or air conditioning (HVAC) system, comprising:

a sensor configured to detect a non-zero concentration of refrigerant in air; and a controller including an extended system-off timer, wherein the controller is configured to:

receive feedback from the sensor indicative of the non-zero concentration of the refrigerant in the air;

determine, based on the feedback, whether the non-zero concentration of the refrigerant in the air is less than a threshold value;

determine whether the HVAC system is in an operating mode indicative of an unsatisfied call for conditioning or a non-operating mode indicative of a satisfied call for conditioning;

operate a blower of the HVAC system for a first predetermined time period based on a first determination that the non-zero concentration of the refrigerant in the air is less than the threshold value and a second determination that the HVAC system is in the operating mode; and operate the blower of the HVAC system for a second predetermined time period based on the first determination and a third determination that the HVAC system is in the non-operating mode, wherein the second predetermined time period is different than the first predetermined time period, wherein the extended system-off timer of the controller is configured to measure an elapsed time in response to the third determination, and wherein the controller is configured to initiate operation of the blower of the HVAC system for the second predetermined time period after the elapsed time exceeds a time period delay.

2. The control system of claim 1, wherein the controller includes a normal system operation timer configured to measure an additional elapsed time, wherein the controller is configured to determine whether the first predetermined time period has elapsed based on the additional elapsed time, and wherein the controller is configured to reset the normal system operation timer after operating the blower for the first predetermined time period.

3. The control system of claim 1, wherein the controller is configured to:

determine whether the non-zero concentration of the refrigerant in the air is greater than the threshold value; and suspend operation of a compressor of the HVAC system and an outdoor fan of the HVAC system based on the second determination and a fourth determination that the non-zero concentration of the refrigerant in the air is greater than the threshold value.

4. The control system of claim 3, wherein the controller is configured to:

cyclically activate and deactivate operation of the blower for a predetermined number of cycles after suspending operation of the compressor and the outdoor fan.

5. The control system of claim 3, wherein the controller is configured to:

cyclically activate and deactivate operation of the blower after suspending operation of the compressor and the outdoor fan until input indicative of a manual reset is received.

6. The control system of claim 1, wherein the controller is configured to:

determine whether the non-zero concentration of the refrigerant in the air is greater than the threshold value; and cyclically activate and deactivate operation of the blower for a predetermined number of cycles based on the third determination and a fourth determination that the non-zero concentration of the refrigerant in the air is greater than the threshold value.

7. The control system of claim 6, wherein the controller is configured to:

transmit an alert indicative of a leak fault mode to a user interface; and receive input indicative of a manual reset of the leak fault mode from the user interface.

8. The control system of claim 1, wherein the controller is configured to resume normal operation of the HVAC system and continue to receive feedback from the sensor after operating the blower for the first predetermined time period.

9. A refrigerant leak management system for a heating, ventilation, and/or air conditioning (HVAC) system, comprising:

a sensor configured to detect a concentration of refrigerant in air;

a timer; and a controller including a processor that is communicatively coupled to the sensor and the timer, wherein the controller is configured to:

receive feedback from the sensor indicative of the concentration of the refrigerant in the air;

determine whether the concentration of the refrigerant in the air is less than a threshold value;

determine whether the HVAC system is in an operating mode indicative of an unsatisfied call for conditioning or a non-operating mode indicative of a satisfied call for conditioning;

operate a blower of the HVAC system for a first predetermined time period based on a first determination that the concentration of the refrigerant in the air is less than the threshold value and a second determination that the HVAC system is in the operating mode; and operate the blower of the HVAC system for a second predetermined time period based on the first determination, a third determination that the HVAC system is in the non-operating mode, and a fourth determination that an elapsed time measured by the timer exceeds a time delay period.

10. The refrigerant leak management system of claim 9, wherein the controller is configured to:

determine whether the concentration of the refrigerant in the air is greater than the threshold value; and in response to a fifth determination that the concentration of the refrigerant in the air exceeds the threshold value, cyclically operate the blower for a threshold on period and deactivate the blower for a threshold wait period until a stop condition is satisfied.

11. The refrigerant leak management system of claim 10, wherein the stop condition is satisfied when a threshold number of cycles have been performed.

12. The refrigerant leak management system of claim 10, wherein the stop condition is satisfied when user input indicative of a manual reset is received.

13. The refrigerant leak management system of claim 10, wherein the controller is configured to:

suspend operation of a compressor and an outdoor fan of the HVAC system in response to the fifth determination that the concentration of the refrigerant in the air exceeds the threshold value.

14. The refrigerant leak management system of claim 9, wherein the operating mode is a cooling mode, a dehumidification mode, a heating mode, or a combination thereof.

15. A heating, ventilation, and/or air conditioning (HVAC) system, comprising:

a sensor configured to detect a concentration of refrigerant in air;

a blower configured to direct conditioned air to a conditioned space; and a controller configured to:

receive feedback from the sensor indicative of the concentration of the refrigerant in the air;

determine whether the concentration of the refrigerant in the air is greater than zero and less than a threshold value;

determine whether the HVAC system is in an operating mode indicative of an unsatisfied call for conditioning or a non-operating mode indicative of an absence of the unsatisfied call for conditioning;

operate, in response to a first determination that the concentration of the refrigerant in the air is greater than zero and less than the threshold value and a second determination that the HVAC system is in the operating mode, the blower of the HVAC system for a first predetermined time period;

wait, in response to the first determination and a third determination that the HVAC system is in the non-operating mode, for a time delay period; and operate, after the time delay period, the blower of the HVAC system for a second predetermined time period.

16. The HVAC system of claim 15, comprising a compressor and an outdoor fan, each communicatively coupled to the controller, wherein the controller is configured to:

determine whether the concentration of the refrigerant in the air is greater than the threshold value;

and suspend operation of the compressor and the outdoor fan in response to the second determination and a fourth determination that the concentration of the refrigerant in the air is greater than the threshold value.

17. The HVAC system of claim 15, wherein the controller is configured to:

determine whether the concentration of the refrigerant in the air is greater than the threshold value;

suspend normal operation of the HVAC system in response to a fourth determination that the concentration of the refrigerant in the air is greater than the threshold value; and cyclically activate and deactivate operation of the blower for a predetermined number of cycles while the normal operation of the HVAC system is suspended.

18. The HVAC system of claim 15, wherein the blower and the sensor are disposed in an air-handling enclosure of the HVAC system, and wherein the sensor is disposed downstream of an evaporator of the HVAC system relative to a flow direction of the conditioned air through the air-handling enclosure.

19. The control system of claim 1, wherein the first predetermined time period comprises a first amount of time, the second predetermined time period comprises a second amount of time, and the first amount of time is greater than the second amount of time.

20. The control system of claim 1, wherein the first predetermined time period comprises a first amount of time, the second predetermined time period comprises a second amount of time, and the first amount of time is less than the second amount of time.

21. The control system of claim 1, wherein the sensor is disposed within a supply outlet duct of the HVAC system.

22. The control system of claim 1, wherein the sensor is disposed between an evaporator of the HVAC system and the blower of the HVAC system.

23. The refrigerant leak management system of claim 9, wherein the sensor is disposed within a supply outlet duct of the HVAC system.

24. The refrigerant leak management system of claim 9, wherein the sensor is disposed between an evaporator of the HVAC system and the blower of the HVAC system.

25. The HVAC system of claim 15, wherein the sensor is disposed within a supply outlet duct of the HVAC system.

26. The HVAC system of claim 15, wherein the sensor is disposed between an evaporator of the HVAC system and the blower of the HVAC system.

* * * * *